United States Patent [19]

Fuller

[11] 4,047,409

[45] Sept. 13, 1977

[54] KEY CONTROLLED LOCK

[75] Inventor: David W. Fuller, Rosemead, Calif.

[73] Assignee: Addmaster Corporation, San Gabriel, Calif.

[21] Appl. No.: 721,667

[22] Filed: Sept. 9, 1976

[51] Int. Cl.[2] ..... E05B 29/06

[52] U.S. Cl. ..... 70/356; 70/358; 70/362; 70/376

[58] Field of Search ..... 70/347, 356, 358, 362, 70/364 R, 364 A, 376, 377, 420, DIG. 32

[56] References Cited

U.S. PATENT DOCUMENTS

| | | | |
|---|---|---|---|
| 1,713,602 | 5/1929 | Heiden | 70/DIG. 32 |
| 2,721,470 | 10/1955 | Hensel | 70/346 |
| 3,621,682 | 11/1971 | Schmidt | 70/364 R |
| 3,802,230 | 4/1974 | Tickett | 70/376 X |
| 3,855,829 | 12/1974 | Lipschutz | 70/362 |

*Primary Examiner*—Robert L. Wolfe
*Attorney, Agent, or Firm*—Fred N. Schwend

[57] ABSTRACT

A key controlled lock for electrical switches, etc., in which a rotatably supported plastic switch actuator element is provided with a substantially diametrically extending keyway at one end to receive a key. Locking fingers of a plastic yieldable locking device normally engage in opposite side of the keyway. The key, upon insertion in the keyway, cams the fingers outwardly to release the actuator element for rotation by the key.

8 Claims, 10 Drawing Figures

FIG. 1.
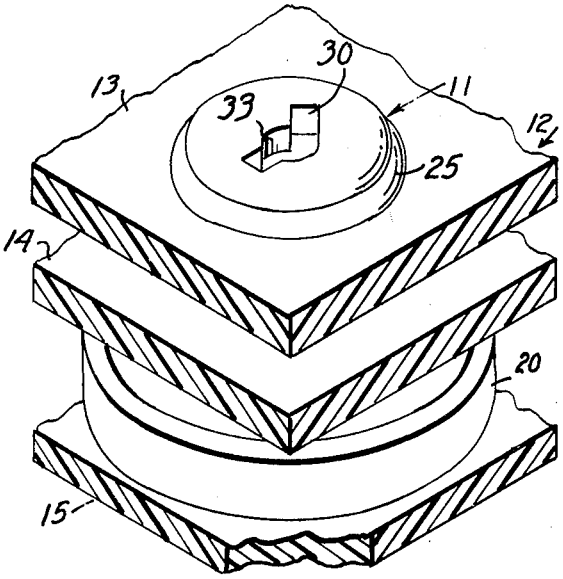
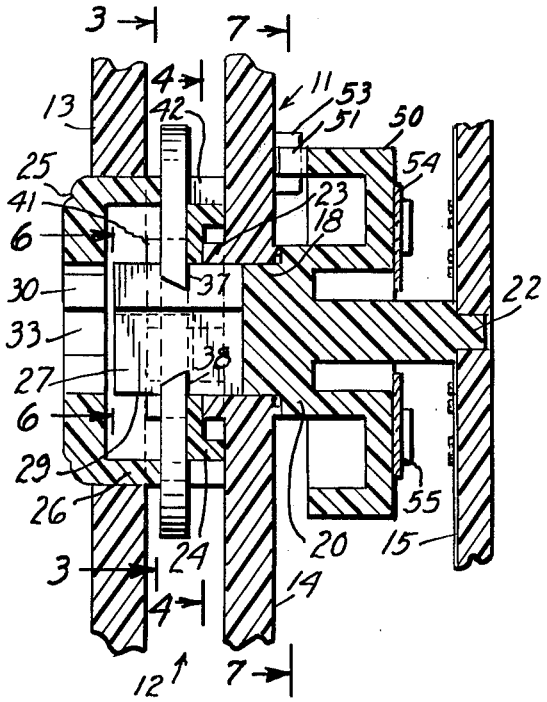
FIG. 2.
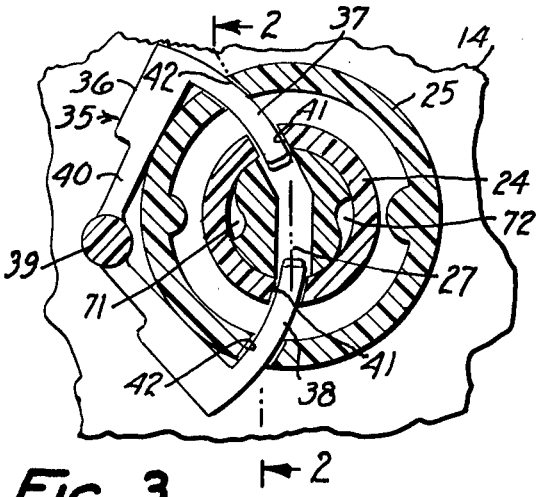
FIG. 3.
FIG. 4.
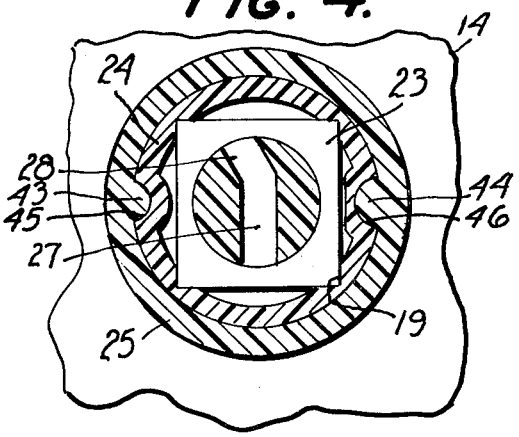
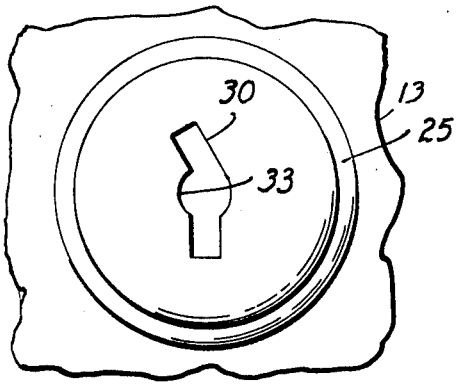
FIG. 5.
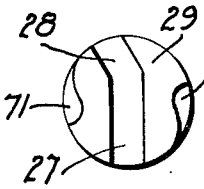
FIG. 6.

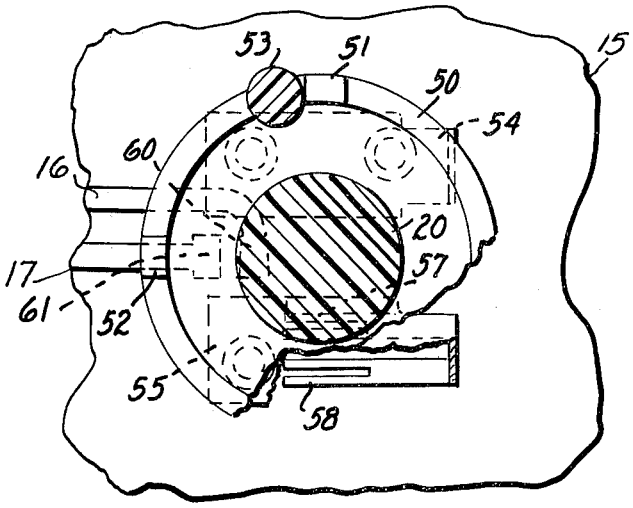
FIG. 7.
FIG. 8.
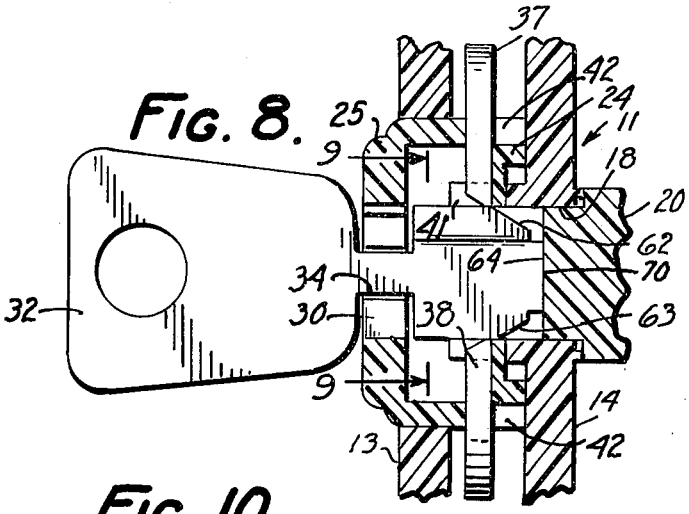
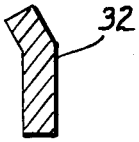
FIG. 9.
FIG. 10.
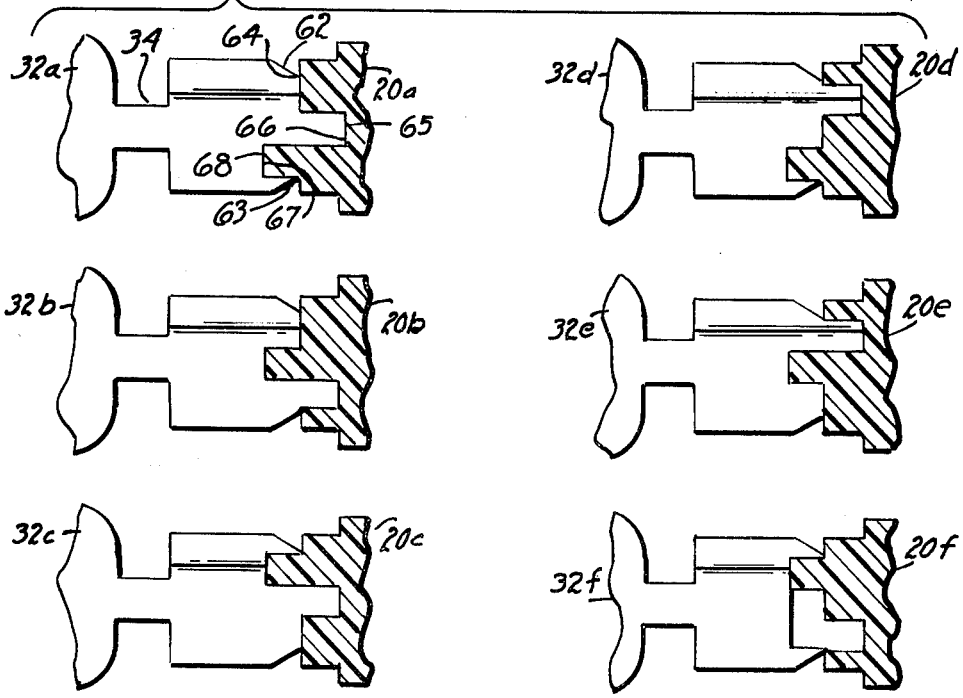

KEY CONTROLLED LOCK

BACKGROUND OF THE INVENTION

1. Field of the Invention

This invention relates to key controlled locks and has particular reference to inexpensive key controlled locks effective, for example, to control electric switches.

2. Description of the Prior Art

Key controlled locks of the above type having adequate safequard features to prevent unauthorized operation without a key of proper configuration, have generally been of the tumbler type, including a cylinder, a key receiving plug within the cylinder, and locking tumbler pins carried by the plug and settable by a key inserted in the plug to unlock the plug from the cylinder. Such locks generally embody small springs, tumblers, and other parts which must be precision manufactured to close tolerances to insure proper operation. Also, the parts must normally be made of relatively expensive materials and must be properly cleaned and lubricated to prevent malfunctioning due to corrosion, rust, etc.

Also, particularly in connection with electronic processing equipment, such as electronic cash registers, where key controlled locks are often employed to prevent unauthorized use or to establish certain modes of operation of the equipment, the use of metal key locks on the equipment may allow static electrical charges to be transmitted to certain of the sensitive electronic circuits and components which could cause malfunctioning or even damage.

SUMMARY OF THE INVENTION

A principal object of the present invention is to provide a simple and inexpensive key controlled lock which may be made of plastic or similar electrically insulative materials.

Another object is to provide a key controlled lock which is relatively immune to malfunctioning due to exposure to the weather.

Another object is to provide a key controlled lock which does not require precision made components.

Another object is to provide a key controlled lock for an electric switch which will not transmit static electrical charges to the switch or to the circuit or circuits controlled by the switch.

Another object is to provide a key controlled lock particularly suited for controlling electrical switches and the like.

BRIEF DESCRIPTION OF THE DRAWINGS

The manner of which the above and other objects of the invention are accomplished will be readily understood on reference to the following specification when read in conjunction with the accompanying drawings, wherein:

FIG. 1 is a perspective view of a key controlled lock assembly embodying a preferred form of the present invention.

FIG. 2 is a longitudinal view through the lock assembly, shown associated with an electrical switch, and is taken substantially along line 2—2 of FIG. 3.

FIG. 3 is a transverse sectional view taken along line 3—3 of FIG. 2.

FIG. 4 is a transverse sectional view taken along line 4—4 of FIG. 2.

FIG. 5 is a front view of the lock assembly.

FIG. 6 is a detailed front view of the actuator and is taken along the line 6—6 of FIG. 2.

FIG. 7 is a transverse sectional view taken along line 7—7 of FIG. 2, with parts broken away.

FIG. 8 is a sectional view similar to that of FIG. 2 but illustrating a key inserted in the lock.

FIG. 9 is a detailed sectional view through the actuating portion of the key and is taken along the line 9—9 of FIG. 8.

FIG. 10 is a view showing fragmentary sections of different key configurations and related mating actuator formations.

DESCRIPTION OF THE PREFERRED EMBODIMENT

Referring to the drawings, the key lock, generally indicated at 11, is shown as embodied in a keyboard 12 of an electronic cash register for the purpose of opening and closing an electrical circuit, although it should be understood that the lock may also be used in many other applications.

The keyboard 12 comprises a keyboard panel plate 13 and a base plate 14, both preferably of plastic. Such plates are suitably supported in spaced relation to each other and to a printed circuit board 15, also preferably of plastic or other electrically insulating material, having metal conductors 16 and 17, FIG. 7, formed on the surface thereof adjacent base plate 14. Conductors 16 and 17 form part of the above noted electric circuit to be selectively opened and closed by switch contacts operable by the lock, as will be described later.

Base plate 14 has a bearing 18 formed therein in which a key operated switch actuator 20 is journaled. The latter is also preferably of plastic and has an axially projecting extension 22 at its right hand end which is rotatably supported in a bearing formed in the circuit board 15.

The base plate 14 is formed with a square hub 23, FIGS. 2 and 4, which surrounds the bearing 18 and has fitted thereover a bushing 24 of plastic which is prevented from turning due to the mating of indentations 19 therein with the sharp corners of the hub 23.

A cup shaped cover member 25 is fitted within an opening formed in the panel plate 13 in axial alignment with the actuator 20. The annular wall 26 of member 25 is fitted over bushing 24 and is secured to the base plate 14 by a suitable adhesive, not shown.

A key way 27 is formed in the actuator 20 along the left hand cylindrical portion 29 thereof and extends substantially diametrically thereacross. The slot 27 is angled at 28, requiring a key, i.e. 32, FIGS. 8 and 9, of similar shape to be fitted endwise therein. A key slot 30 is formed in the end wall of the cover member 25 and has the same general cross sectional shape as the keyway 27 to permit insertion of the key 32. In addition, however, the slot 30 has a rounded central opening 33 which registers with a recessed section 34 on the key 32 when the latter is fully inserted in the keyway 27, to permit turning of the key.

According to the present invention, a locking device 35, FIG. 3, is provided to normally lock the actuator 20 against rotation. Such locking device is also preferably of plastic and comprises a substantially V-shaped section 36 terminating in opposed arcuate locking fingers 37 and 38 which normally extend partly into the diametrically opposite parts of keyway 27. The section 36 is reduced in cross section at 40 to enable flexing of the same when the locking fingers 37 and 38 are cammed apart by the key 32, as seen in FIG. 8.

The section 36 normally rests against the outer periphery of the cover member 25 and the locking fingers 37 and 38 are slidable endwise through slots 41 and 42 formed in the ends of the bushing 24 and cover member 25, respectively. A hub 39 on the locking device 35 guides the latter against the side of the base plate 14.

It will be seen that the slots 41 and 42 guide the locking fingers 37 and 38, and thus the locking device 35, against movement about the axis of the actuator 20. Also, the left hand face of the bushing 24 and the left hand ends of the slots 42 guide the locking device 35 against lateral movement. However, in order to facilitate assembly of the parts, the slots 41 and 42 are open ended. Thus, during assembly, the bushing 24 is first mounted on the hub 23. The locking device is then fitted sideways into the slots 41 and keyway 27. Finally, the cover member 25 is installed endwise with the slots 42 fitting over the locking fingers 37 and 38.

In order to properly orient the cover member 25 during assembly to insure that the key slot 30 is aligned with the keyway 27 to permit insertion of the key 32, rounded tongues 43 and 44, FIG. 4, are formed on diametrically opposite sides of the cover member to mate with corresponding grooves 45 and 46, respectively, in the bushing 24. The tongue 44 is somewhat larger than tongue 43 so that the cover member can be assembled on the bushing 24 in one position only.

The actuator 20 has a flanged portion 50 from which two projections 51 and 52, FIGS. 2 and 7, extend. Such projections are located approximately 90° apart and are engageable with a limit stop 53 projecting from the base plate 14 to limit rotation of the actuator.

Two diametrically opposed spring contact brushes 54 and 55 are suitably secured to the flanged portion 50 and each comprises a pair of spaced spring fingers 57 and 58 yieldably engaging the printed circuit board 15. As the actuator 20 is rocked clockwise, as viewed in FIG. 7, from the one extreme to the other, the spring fingers 57 and 58 move into bridging engagement with pads 60 and 61 on the conductors 16 and 17, respectively, to complete a circuit through the conductors.

As seen in FIG. 8, the key 32 has inclined camming edges 62 and 63 thereon which, when the key 32 is fully inserted in the keyway 27, cam the locking fingers 37 and 38 outward, out of engagement with the keyway 27 to release the actuator 20 so that the key 32 may then be turned to likewise turn the actuator until the switch closure is made.

The width of the right hand portion of key 32 is preferably the same as the diameter of the left hand portion of the actuator 20. Thus, as the actuator is turned from its normal locked position the locking fingers 37 and 38 will merely ride against the cylindrical portion 29 of the actuator.

Means are provided for yieldably detenting the actuator 20 in its clockwise rocked position and, for this purpose, a pair of diametrically opposed detent grooves 71 and 72 are formed along the portion 29 of the actuator 20, FIGS. 3 and 6. As the actuator is moved into its extreme clockwise position, the locking fingers 37 and 38 drop into such detent grooves. However, when the actuator 20 is subsequently returned counterclockwise the grooves 71 and 72 cam the respective locking fingers outwardly so that they again ride on the cylindrical surface of the actuator portion 29.

It will be noted that when the key 32 is fully inserted, its right hand end 70 will engage the inner end 64 of the keyway 27.

As noted in FIG. 10, different key configurations **32*a* to 32*f* may be provided in which the bodies of the keys are similar but the right hand ends thereof are formed in different shapes which must mate with correspondingly shaped formations on the actuators, i.e., 20*a* to 20*f*, in order to permit full insertion of the keys so that they can be turned to turn the respective actuators. For example, key 32*a* has a centrally located tongue 65 which mates with a centrally located groove 66 formed in actuator 20*a*. On the other hand, a groove 67 formed in the end of the key 32*a* adjacent the lower edge thereof mates with a correspondingly located tongue 68 projecting from the bottom 64 of the keyway in actuator 20*a***.

Since all parts of the lock are formed of plastic, static electrical charges cannot be transferred from the key 32 to the contact brushes 54, 55 or to the circuit conductors, i.e. 16 and 17.

It will be obvious to those skilled in the art that many variations may be made in the exact construction shown without departing from the spirit of this invention.

I claim:

1. A key controlled lock comprising a base structure forming a cylindrical bearing, an actuator rockable in said bearing, said actuator having a keyway extending at least substantially diametrically across one end portion thereof, a flexible locking element having a pair of locking fingers normally engaging in the opposite sides of said keyway to prevent rocking of said actuator member, means supporting said locking member eccentrically of said bearing, said last mentioned means preventing movement of said locking member about the axis of said bearing, a key insertable endwise in said keyway, said key having camming means thereon effective to cam said locking fingers out of said keyway and to flex said locking element upon insertion of said key in said keyway to permit rocking of said actuator member by said key.

2. A key controlled lock as defined in claim 1 wherein said preventing means comprises means on said base structure slidably supporting said locking fingers for movement into and out of said keyway, said locking element being otherwise unsupported.

3. A key controlled lock as defined in claim 1 wherein said actuator member has a first irregular formation extending into said keyway and said key has a second irregular formation mating with first irregular formation, and means enforcing insertion of said key into said keyway a predetermined amount.

4. A key controlled lock as defined in claim 3 wherein said first irregular formation comprises a first tongue and a first groove on said actuator member, and said second irregular formation comprises a second tongue and a second groove on said key engageable with said first groove and said first tongue, respectively.

5. A key controlled lock comprising a base member forming a bearing, an actuator member having a cylindrical section rockable in said bearing, said actuator member having a keyway extending at least substantially diametrically across one end portion of said cylindrical section, a flexible locking element have a pair of locking fingers on opposite ends thereof;

said fingers normally engaging in said keyway on opposite sides of said cylindrical section to prevent rocking of said actuator member, a key insertable endwise in said keyway, said key having camming means thereon effective to cam said locking fingers out of said keyway and to flex said locking element, means on said base member for guiding said locking fingers into and out of said keyway, a cover member fixed relative to said base member, said cover member having a key slot for receiving said key and, means on said cover member for guiding said locking fingers into and out of said keyway, said key having a relieved section therein which is aligned with said key slot when said key is fully inserted in said keyway whereby to permit rotation of said actuator member by said key.

6. A key controlled lock as defined in claim 5 wherein said guide means on said base member and said guide means on said cover member comprise guide slots for said locking fingers.

7. A key controlled lock as defined in claim 1 comprising detent means on said actuator member engageable by at least one of said locking fingers upon rocking of said actuator member whereby to detent said actuator member in a rocked position.

8. A key controlled lock as defined in claim 1 comprising detent notches in said actuator member engageable by respective ones of said locking fingers upon rocking of said actuator member whereby to detent said actuator member in a rocked position.

* * * * *